US011019951B2

(12) United States Patent
Wright et al.

(10) Patent No.: US 11,019,951 B2
(45) Date of Patent: Jun. 1, 2021

(54) COLLAPSIBLE HANGER

(71) Applicant: ELECTROLUX HOME PRODUCTS, INC., Charlotte, NC (US)

(72) Inventors: Erin Smith Wright, Indian Trail, NC (US); Brian Roderman, Plano, TX (US); David Singer, Austin, TX (US); Justin Pendleton, The Colony, TX (US); Sara Roueche Dulski, Huntersville, NC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 16/368,480

(22) Filed: Mar. 28, 2019

(65) Prior Publication Data

US 2019/0298094 A1 Oct. 3, 2019

Related U.S. Application Data

(60) Provisional application No. 62/650,806, filed on Mar. 30, 2018.

(51) Int. Cl.
*A47G 25/40* (2006.01)

(52) U.S. Cl.
CPC ..... *A47G 25/4023* (2013.01)

(58) Field of Classification Search
CPC ..... A47G 25/4015; A47G 25/4023; A47G 25/403; A47G 25/4038; A47G 25/4053
USPC ..... 223/89, 90, 94
See application file for complete search history.

(56) References Cited

U.S. PATENT DOCUMENTS

| | | | | |
|---|---|---|---|---|
| 735,443 | A | 12/1899 | Baer | |
| 768,446 | A | 12/1899 | Gager | |
| 958,366 | A * | 5/1910 | Clausen | A47G 25/4023 223/89 |
| 1,111,147 | A * | 9/1914 | Fogde | A47G 25/4023 223/89 |
| 1,258,452 | A * | 3/1918 | Pierce | A47G 25/4023 223/89 |
| 2,435,301 | A | 2/1948 | Langley et al. | |
| 2,439,838 | A | 4/1948 | Wingate et al. | |

(Continued)

FOREIGN PATENT DOCUMENTS

| | | |
|---|---|---|
| KR | 1761743 | 7/2017 |
| KR | 1811318 | 12/2017 |

*Primary Examiner* — Nathan E Durham
(74) *Attorney, Agent, or Firm* — Moore & Van Allen PLLC; Peter B. Stewart

(57) ABSTRACT

A collapsible hanger may comprise: a suspendable support base further comprising: a neck having first and second ends; and a support extending from the second end, the support having first and second pegs positioned at first and second ends of the support, respectively; a frame positionable along a length of the neck; first and second extensions operatively coupled to the frame, the first and second extensions defining, respectively, a first channel positioned along at least a portion of a length of the first extension for receiving and guiding the first peg, and a second channel positioned along at least a portion of a length of the second extension for receiving and guiding the second peg, wherein sliding the frame along the length of the neck adjusts a separation distance between the first extension and the second extension and causes movement of each peg along an associated channel.

20 Claims, 7 Drawing Sheets

(56) References Cited

U.S. PATENT DOCUMENTS

| | | | | |
|---|---|---|---|---|
| 2,716,513 | A | 8/1955 | Paul et al. | |
| 2,777,621 | A | 1/1957 | Murray et al. | |
| 2,814,426 | A * | 11/1957 | Miller | A47G 25/442 223/94 |
| 2,881,965 | A * | 4/1959 | Fetko | A47G 25/4023 223/94 |
| 4,114,786 | A * | 9/1978 | Wiese | A47G 25/4023 223/94 |
| 5,718,358 | A * | 2/1998 | Long | A47G 25/442 223/85 |
| 5,979,721 | A * | 11/1999 | Curtis | A47G 25/50 223/89 |
| 7,828,179 | B2 | 11/2010 | Sprovieri | |
| 8,814,013 | B2 | 8/2014 | Almeida Levi | |
| 9,179,791 | B2 | 11/2015 | Aspera | |
| 9,392,898 | B2 | 7/2016 | Tsukada | |
| 2006/0054646 | A1 * | 3/2006 | Nathanmanna | A47G 25/4023 223/89 |
| 2007/0158374 | A1 | 7/2007 | Chan | |
| 2010/0059557 | A1 | 3/2010 | Temali et al. | |
| 2011/0284597 | A1 | 11/2011 | Kaleta et al. | |
| 2011/0315723 | A1 | 12/2011 | McClellan | |
| 2013/0264362 | A1 * | 10/2013 | Watanabe | A47G 25/4023 223/85 |
| 2017/0303710 | A1 | 10/2017 | Sabin et al. | |

* cited by examiner

COLLAPSIBLE HANGER

CROSS-REFERENCE TO RELATED APPLICATION

This application claims the benefit of U.S. Provisional Application No. 62/650,806 filed Mar. 30, 2018, the contents of which are hereby incorporated by reference herein in its entirety.

FIELD OF THE INVENTION

The present invention relates to organizing and storing clothing and, more specifically, to a reconfigurable hanger device for accommodating articles of clothing having various sizes and shapes.

BACKGROUND

Garments having small and/or inflexible neck holes or openings can present challenges when combined with traditional, static hangers. A small opening may lead to unintentional damage (i.e., stretching, stressing, or tearing) of a garment during the process of positioning the hanger within the garment for storage. Additionally, garments having buttons require that a user at least partially unbutton the garment to be able to remove it from or securely position it on a typical, rigid hanger. Therefore, there exists a need for an improved collapsible hanger device.

BRIEF SUMMARY

The following presents a simplified summary of one or more embodiments of the invention in order to provide a basic understanding of such embodiments. This summary is not an extensive overview of all contemplated embodiments, and is intended to neither identify key or critical elements of all embodiments, nor delineate the scope of any or all embodiments. Its sole purpose is to present some concepts of one or more embodiments in a simplified form as a prelude to the more detailed description that is presented later.

A collapsible hanger is provided in one embodiment, the collapsible hanger comprising: a suspendable support base further comprising a neck having a first end and a second end; and a support extending from the second end of the neck, the support having a first peg positioned at a first end of the support and a second peg positioned at a second end of the support. The collapsible hanger further comprises a frame positionable along a length of the neck; a first extension operatively coupled to the frame, the first extension defining a first channel positioned along at least a portion of a length of the first extension, the first channel configured to receive and guide the first peg; and a second extension operatively coupled to the frame, the second extension defining a second channel positioned along at least a portion of a length of the second extension, the second channel configured to receive and guide the second peg, wherein repositioning the frame along the length of the neck adjusts a separation distance between the first extension and the second extension and causes movement of the first peg along the at least a portion of the length of the first extension and movement of the second peg along the at least a portion of the length of the second extension.

In one particular embodiment, the neck of the suspendable support base further comprises a third channel configured to receive a protrusion of the frame, wherein the protrusion engages the third channel to at least partially retain and guide the frame along the third channel as the frame moves along the length of the neck. In another particular embodiment, the frame further comprises a locking mechanism configured to releasably engage a deformable tab positioned on the neck of the suspendable support base, the locking mechanism engaging the deformable tab when the collapsible hanger is in an extended state.

In yet another particular embodiment, the first and second extensions are rotatably coupled to the frame at proximal ends of each of the first and second extensions. In yet another particular embodiment, repositioning the frame along the length of the neck adjusts a separation distance between distal ends of each of the first and second extensions, the separation distance between the distal ends being greater in an extended state than in a collapsed state.

In yet another particular embodiment, the suspendable support base further comprises a hooked attachment member extending from the first end of the neck. In yet another particular embodiment, each of the first extension and second extension forms a hook proximate a distal end of each of the first extension and the second extension.

A collapsible hanger is also provided in another embodiment, the collapsible hanger comprising a suspendable support base further comprising a neck with a first end and a second end; and a support arm extending from the second end of the neck. The collapsible hanger further comprises a frame positionable along a length of the neck; a first extension forming a first hinged attachment at a first end of the frame; and a second extension forming a second hinged attachment at a second end of the frame spaced apart from the first hinged attachment, wherein the first extension and the second extension are movably coupled to the support arm.

In one particular embodiment, repositioning the frame along the length of the neck repositions the first extension and the second extension between an extended state and a collapsed state. In another particular embodiment, in the extended state, a separation distance between distal ends of the first extension and the second extension is greater than in the collapsed state.

In yet another particular embodiment, the support arm has a first peg positioned at a first end of the support arm and a second peg positioned at a second end of the support arm, wherein the first extension defines a first channel positioned along a length of the first extension and the second extension defines a second channel positioned along a length of the second extension, and wherein the first channel and the second channel are configured to receive and guide the first peg and the second peg respectively. In yet another particular embodiment, repositioning the frame along the length of the neck causes movement of the first peg along the length of the first extension and movement of the second peg along the length of the second extension.

In yet another particular embodiment, the neck of the suspendable support base further comprises a channel configured to receive a protrusion of the frame, wherein the protrusion engages the channel to at least partially retain and guide the frame along the channel as the frame moves along the length of the neck. In yet another particular embodiment, the frame further comprises a locking mechanism configured to releasably engage a deformable tab positioned on the neck of the suspendable support base, the locking mechanism engaging the deformable tab when the collapsible hanger is in an extended state.

In yet another particular embodiment, the suspendable support base further comprises a hooked attachment member extending from the first end of the neck. In yet another particular embodiment, each of the first extension and second extension forms a hook proximate a distal end of each of the first extension and the second extension.

A collapsible hanger is also provided in yet another embodiment, the collapsible hanger comprising a suspendable support base further comprising a neck with a first end and a second end; and a support arm extending from the second end of the neck. The collapsible hanger further comprises a frame positionable along a length of the neck; a first extension rotatably coupled to a first end of the frame; and a second extension rotatably coupled to a second end of the frame, wherein the first extension and the second extension are movably coupled to the support arm. In one particular embodiment, repositioning the frame long the length of the neck adjusts the separation distance between the first extension and the second extension.

In another particular embodiment, the neck further comprises a channel configured to receive a protrusion of the frame, wherein the protrusion engages the channel to at least partially retain and guide the frame along the channel as the frame moves along the length of the neck. In yet another particular embodiment, the frame further comprises a locking mechanism configured to releasably engage a deformable tab positioned on the neck, the locking mechanism engaging the deformable tab when the collapsible hanger is in an extended state.

The features, functions, and advantages that have been discussed may be achieved independently in various embodiments of the present invention or may be combined with yet other embodiments, further details of which can be seen with reference to the following description and drawings.

BRIEF DESCRIPTION OF THE DRAWINGS

Figure 1:
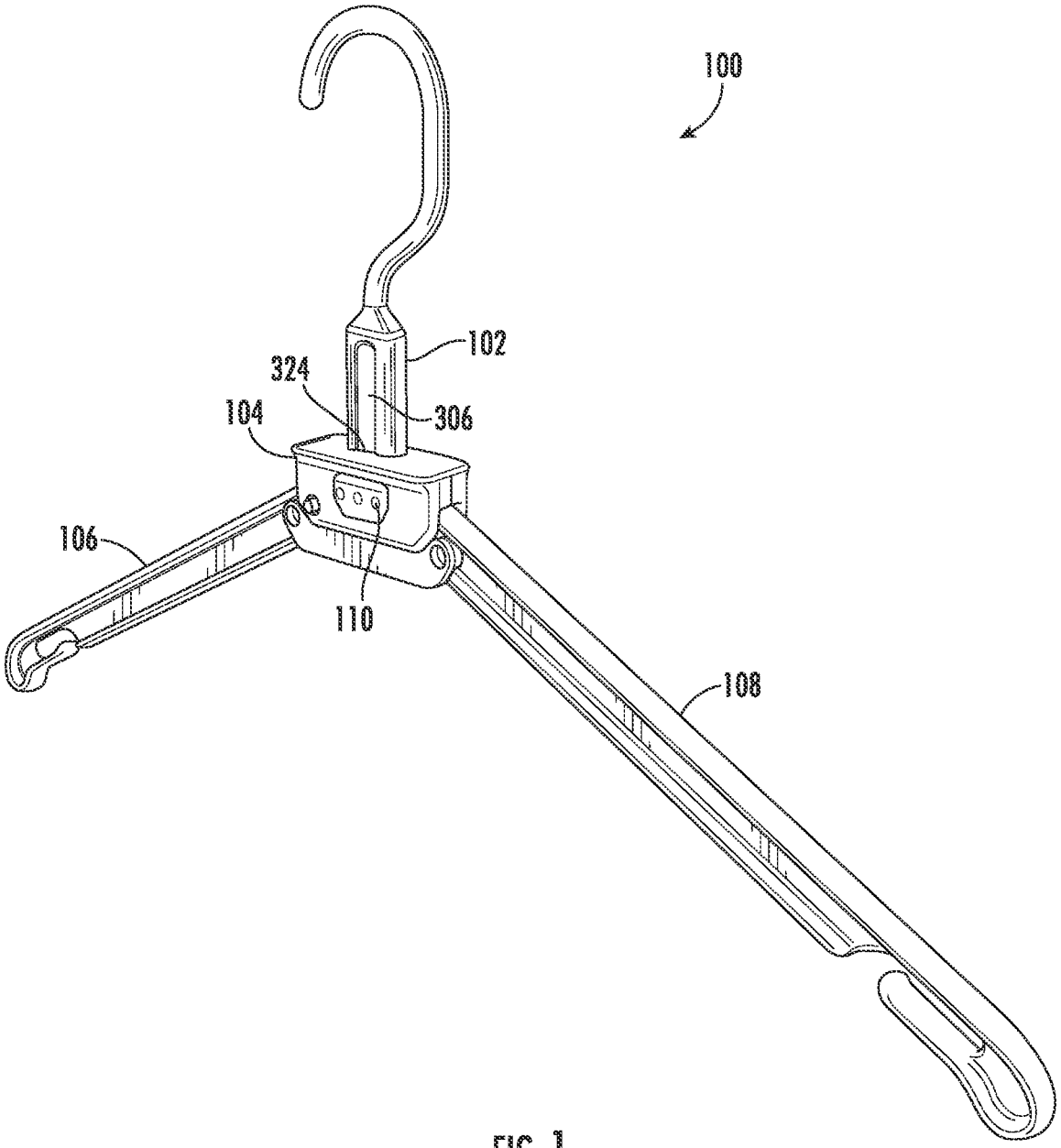
Figure 2:
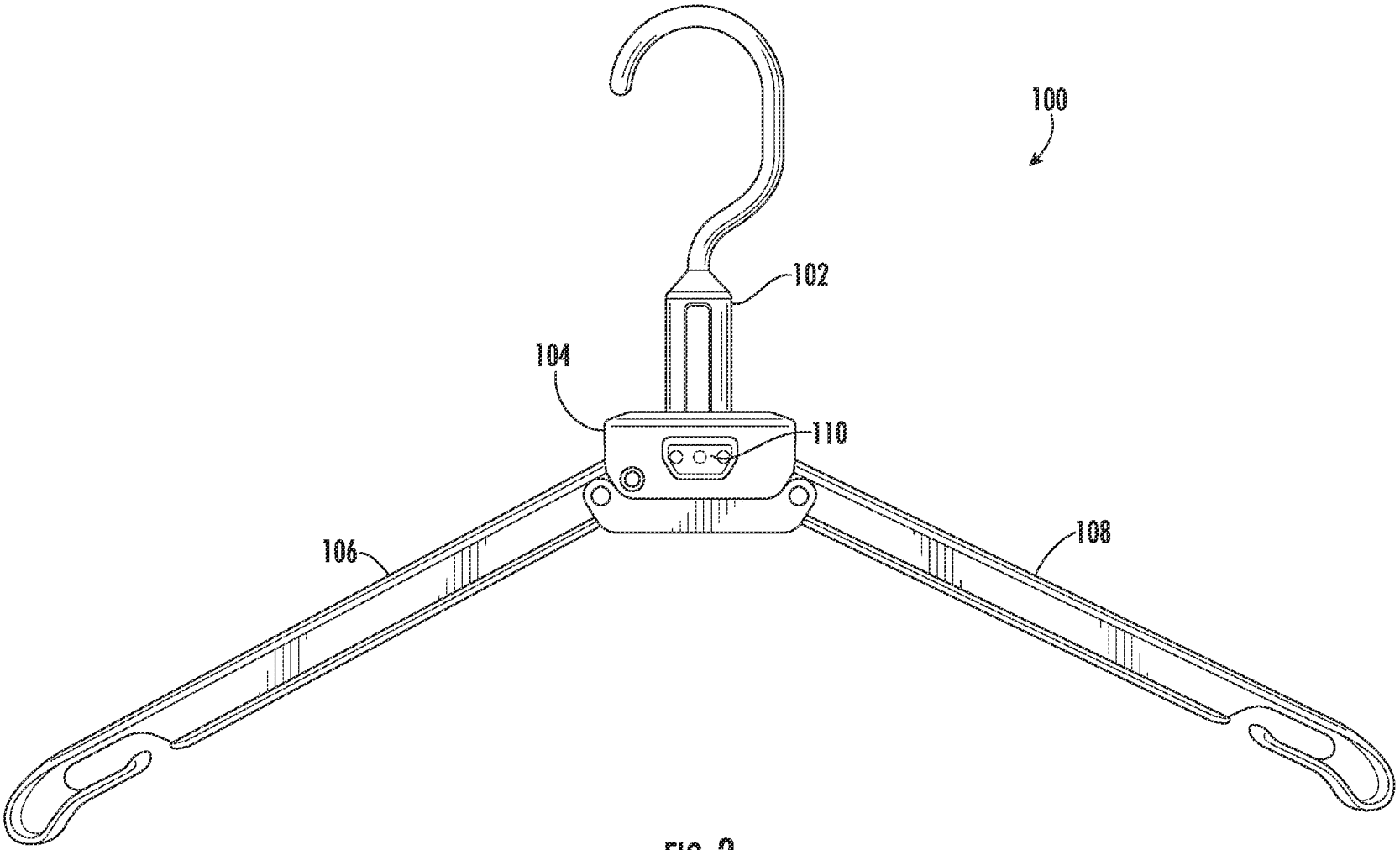
Figure 3:
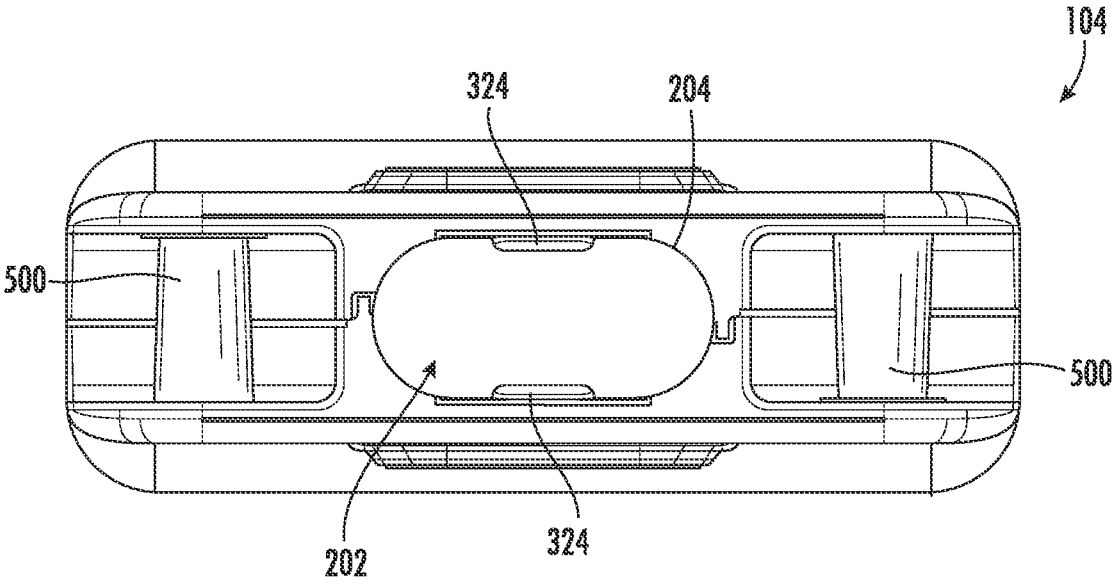
Figure 4:
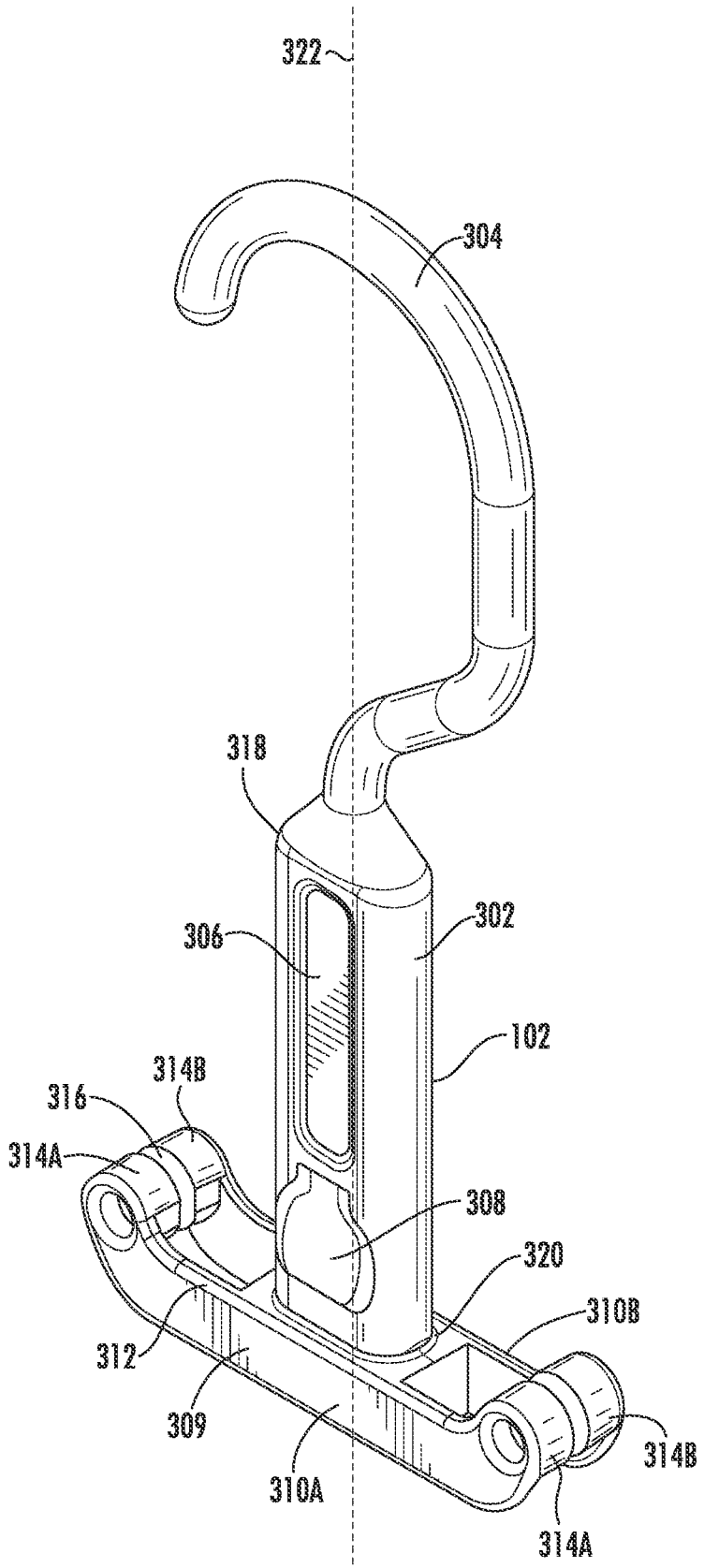
Figure 5:
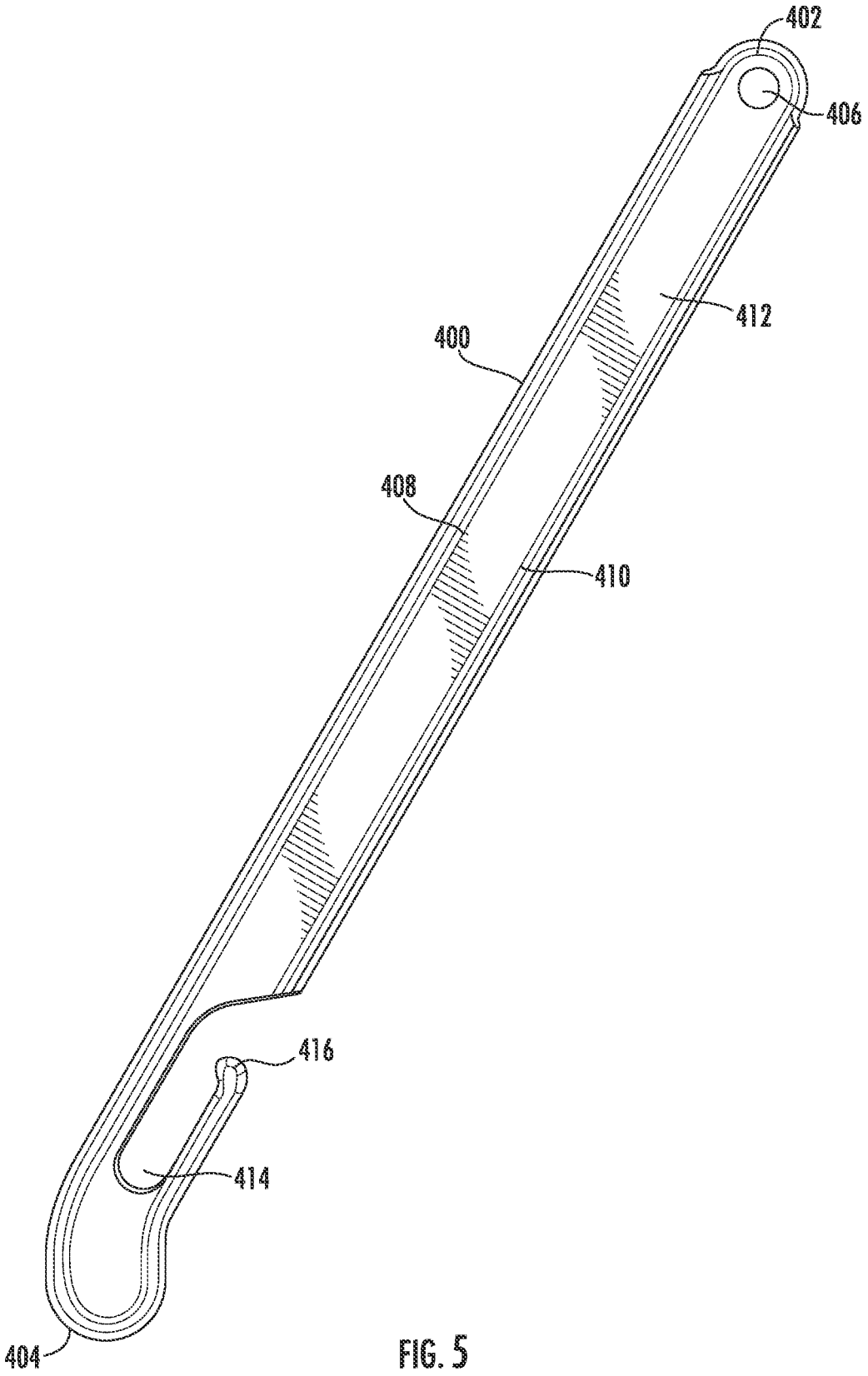
Figure 6:
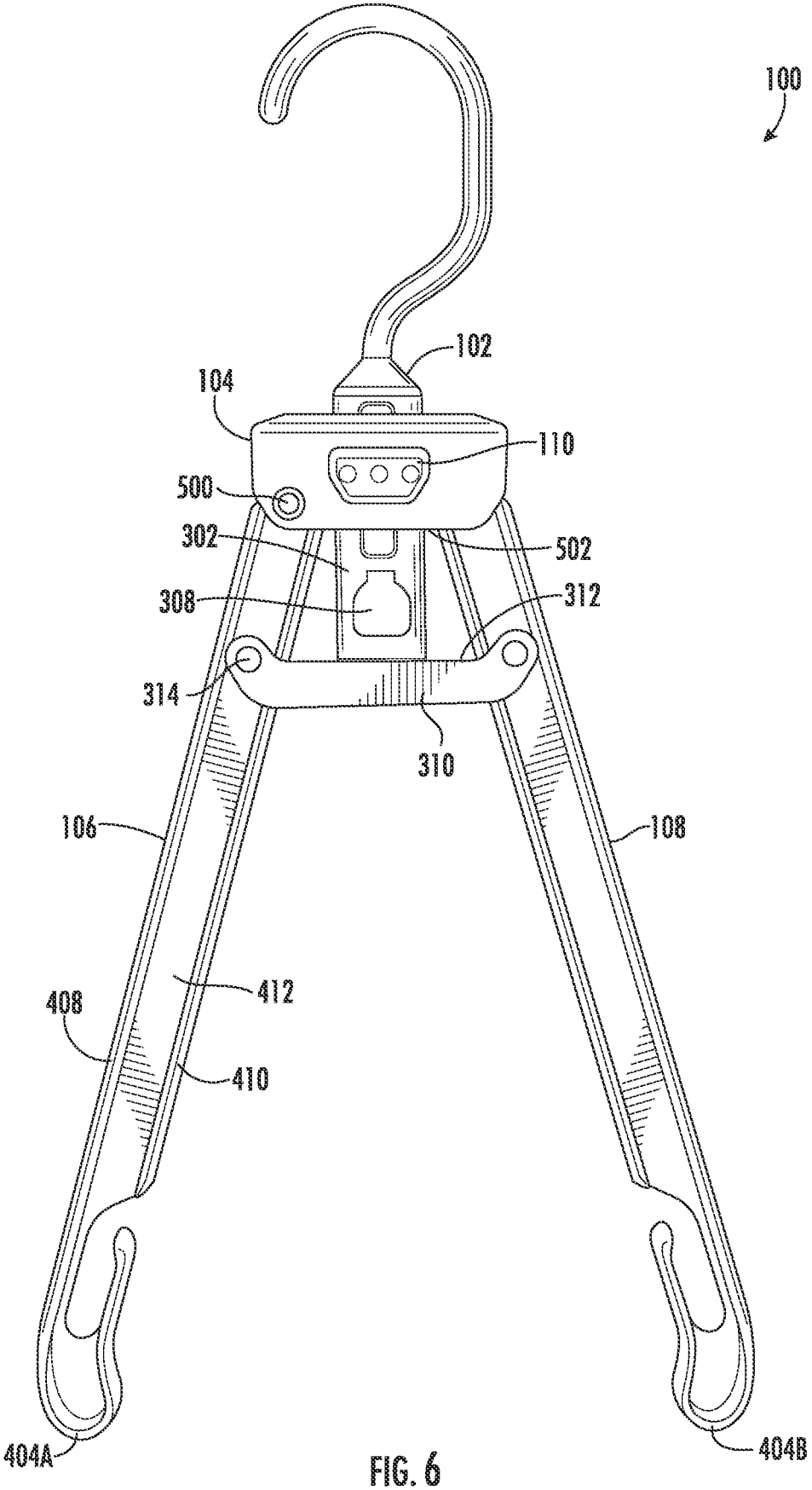
Figure 7:
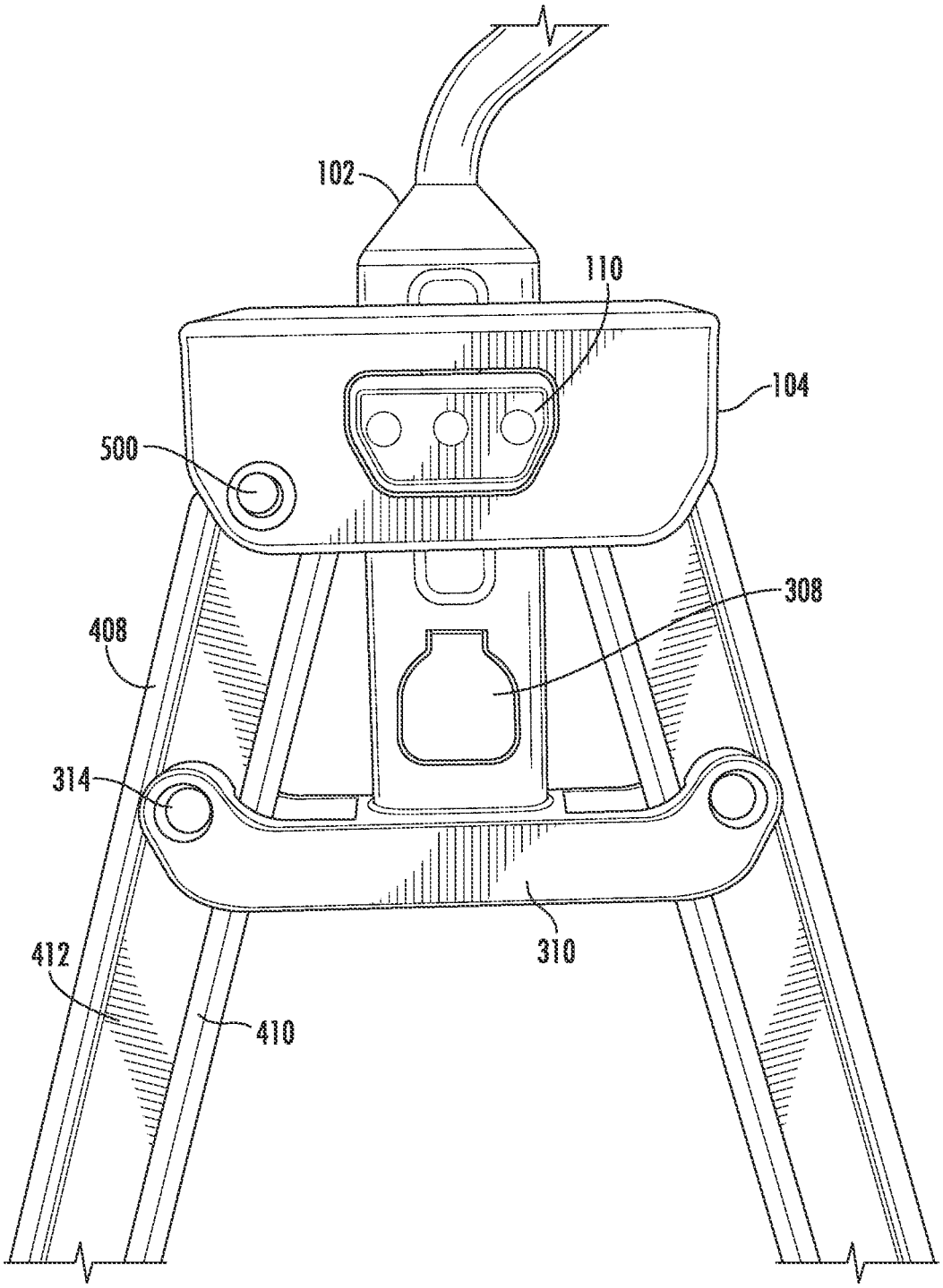

Having thus described embodiments of the invention in general terms, reference will now be made to the accompanying drawings, wherein:

FIG. 1 illustrates a perspective view of a collapsible hanger, in accordance with one embodiment of the present invention;

FIG. 2 illustrates a side view of a collapsible hanger in an expanded state, in accordance with one embodiment of the present invention;

FIG. 3 illustrates a bottom view of a frame, in accordance with one embodiment of the present invention;

FIG. 4 illustrates a perspective view of a suspendable support base, in accordance with one embodiment of the present invention;

FIG. 5 illustrates a side view of a hanger extension, in accordance with one embodiment of the present invention;

FIG. 6 illustrates a side view of a collapsible hanger in a collapsed state, in accordance with one embodiment of the present invention; and FIG. 7 illustrates a detailed side view of a collapsible hanger in a collapsed state, in accordance with one embodiment of the present invention.

DETAILED DESCRIPTION OF THE INVENTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

Garments having small and/or inflexible neck holes or openings can present challenges when combined with traditional, static hangers. A small opening may lead to unintentional damage (i.e., stretching, stressing, or tearing) of a garment during the process of positioning the hanger within the garment for storage. Additionally, garments having buttons require that a user at least partially unbutton the garment to be able to remove it from or securely position it on a typical, rigid hanger. Although hangers capable of at least partially collapsing exist, they typically employ a scissor-like construction centered around and relying on a single hinge. Due to their reliance on a single point of action and materials typically used in hanger construction, existing collapsible hangers are prone to failure and breakage at the single hinge. Therefore, there exists a need for an improved collapsible hanger device that provides enhanced durability and versatility over existing products. Embodiments of the present invention are directed to a collapsible hanger device having a design and novel features that overcome the challenges as discussed above and herein.

It should be understood that "operatively coupled," as used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together. Furthermore, operatively coupled components may mean that the components retain at least some freedom of movement in one or more directions or may be rotated about an axis (i.e., rotationally coupled, pivotally coupled).

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

FIG. 1 and FIG. 2 illustrate, respectively, a perspective view and a side view of a collapsible hanger 100, in accordance with one embodiment of the invention. As depicted in the figures, the collapsible hanger 100 comprises a support base 102, a frame 104, a first extension 106, and a second extension 108. The support base 102 is operatively coupled to the frame 104 and both the first and second extensions 106, 108. The support base 102 not only provides a platform for which other components of the hanger 100 may be attached, but also provides support for the collapsible hanger 100 as a whole while in a suspended storage position, wherein the hanger 100 may be suspended or hung from a surface or object (e.g., a closet rod or hook) by the support base 102, such as by an attachment member of the base 102.

The collapsible hanger is moveable between an expanded or extended state (FIG. 1) and a collapsed state (FIG. 6) through manipulation or positioning of the frame 104 with respect to the support base 102 as discussed herein. As illustrated in FIG. 3, which provides a bottom view of a frame 104, the frame 104 includes an interior cavity 202 and aperture 204 for receiving a portion of the support base 102 which extends through the aperture 204 and the frame 104. The frame 104 encircles a portion of the support base 102 and slides along at least a partial length of the support base 102 to transform the collapsible hanger 100 between the expanded and collapsed states. Furthermore, the frame 104 typically includes a button 110 for temporarily disengaging a portion of the frame 104 from the support base 102 to allow for the frame 104 to freely slide along the length of the of the support base 102.

The interior cavity 202 of the frame 104 further receives portions of the first and second extensions 106, 108. In the illustrated embodiment, the first and second extensions 106 and 108 are rotatably coupled within the interior cavity 202 of the frame 104 to enable movement of the extensions 106, 108 between the expanded and collapsed states of the collapsible hanger 100. While the hanger 100 is in the expanded state, the first and second extensions 106 and 108 extend away from the support base 102 to provide arms or a platform for supporting a garment placed on the collapsible hanger 100. While the hanger 100 is in the collapsed state, the first and second extensions 106 and 108 collapse toward one another to reduce an overall width of the collapsible hanger 100.

The first and second extensions 106, and 108 are rotatable about separate points or axes of rotation on the frame 104; however, movement of the extensions 106, 108 is linked through movement of the shared frame 104 relative to the support base 102 to which both extensions 106, 108 are coupled. In this way, movement of the two extensions 106, 108 may be coordinated and synchronized while simultaneously distributing an applied force required for transformation of the hanger 100 to more than one point, thereby improving durability of the device with repeated or prolonged use.

FIG. 4 illustrates a perspective view of a suspendable support base 102, in accordance with one embodiment of the present invention. As depicted by FIG. 4, the support base 102 includes a neck 302 having a first end 318 and a second end 320, the neck 302 extending in a longitudinal direction of the support base 102. In the illustrated embodiment, the support base 102 further includes a hooked attachment member 304 extending from a first end 318 of the neck 302 for coupling the hanger 100 to a surface or object such as a closet rod or hook in a suspended storage position (i.e., hanging). In some embodiments, the attachment member 304 may be rotatably connected about a longitudinal axis 322 of the neck 302 allowing for the attachment member 304 to be repositionable so that the collapsible hanger 100 may be optionally suspended from a variety of directions. For example, a user of the hanger 100 may have already hung a garment on the hanger 100 to be placed in a closet only to discover that the garment is hung in an orientation opposite to a desired garment orientation. The user may be able to rotate the hooked attachment member 304 of the hanger 100 about the vertical axis 322 of the neck 302 (e.g., 180°) to achieve the desired garment orientation without the need to remove and reposition the garment on the hanger 100. In another embodiment, the attachment member 304 may be rotatably connected to the first end 318 of the neck about an axis perpendicular to the longitudinal axis 322 of the neck 302 (e.g., on a hinge or pivotable about a point), wherein the attachment member 304 optionally rotates or collapses toward the neck 302 to produce a more compact form for storage of the hanger 100.

In other embodiments, the collapsible hanger 100 may include an attachment member having a shape other than a hook, such as a closed shape (e.g., a circle). In yet other embodiments, the collapsible hanger 100 may include additional or alternative attachment means other than a hook (e.g., clamps, magnets, adhesives, etc.).

The support base 102 typically further includes a channel 306 positioned on a surface of the neck 302 of the support base 102. In some embodiments, the channel 306 is configured to receive a protrusion 324 (as depicted in FIGS. 1 and 3) of the frame 104 to at least partially retain and guide the frame 104 along the channel 306 of the support base 102 as the frame 104 moves along the length of the neck 302. In some embodiments, the support base 102 may include one or more channels on multiple surfaces of the neck 302 to retain and guide the frame 104.

In some embodiments, the support base 102 also includes a tab 308 configured to releasably engage a portion of the frame 104, such as the button 110, while the hanger 100 is positioned in the expanded state. The tab 308 is recoverably deformable, wherein actuation of the button 110 on the frame 104 applies a pressure to the tab 308 causing the tab 308 to disengage the frame 104 and allow for movement of the frame 104 along the length of the neck 302 of the support base 102. Through engagement of the tab 308 with the frame 104, the collapsible hanger may be releasably locked in the expanded state to prevent the hanger 100 from collapsing under the weight of a hung garment. In one example, the releasable lock of the collapsible hanger 100 may allow for a heavy item (e.g., a coat) to be securely hung on the collapsible hanger 100. In an alternative embodiment, the weight of the hung garment may be sufficient to retain the collapsible hanger 100 in the expanded state.

As further illustrated by FIG. 4, the support base 102 further includes a support 309 positioned proximate the second end 320 of the neck 302. The support 309 further comprises one or more support arms 310A and 310B that are positioned on each side or face of the collapsible hanger 100 proximate the second end 320 of the neck 302, wherein the support arms 310A and 310B extend out from the second end 320 of the neck 302. Each end of each arm typically includes one or more pegs 314. The pegs 314A and 314B of opposing arms 310A and 310B, respectively, are spaced apart from one another to create a gap 316 for receiving therein a portion of the extensions 106 and 108.

FIG. 5 illustrates a side view of an exemplary hanger extension 400, such as the first extension 106 or the second extension 108, in accordance with one embodiment of the present invention. The extension 400 includes a proximal end 402 and a distal end 404. The extension 400 includes an aperture 406 proximate the proximal end 402, wherein the extension 400 is rotatably coupled to the frame 104 via the aperture 406. Stated another way, the extension 400 is pivotally or rotatably coupled to the frame 104 to form a hinged attachment point. In the illustrated embodiment, the extension 400 is operatively coupled to the frame 104 via a boss 500 (as depicted in FIGS. 6 and 7) that passes through the aperture 406 of the extension 400. The boss 500 is operatively coupled to the frame 104 and may partially protrude from at least one side of the frame 104. In one embodiment, the boss 500 is operatively coupled to the frame 104 using staking techniques such as heat staking, cold forming, ultrasonic staking or the like, wherein the thermoplastic boss 500 is expanded to fit the aperture 406 while still allowing for rotation of the aperture 406 and extension 400 about the boss 500 within the frame 104.

In the illustrated embodiment, the extension 400 further includes a protrusion 416 defining an interior slot 414 of the extension 400 proximate the distal end 404. The protrusion 416 and interior slot 414 provide an additional hook and space for securely hanging, for example, garments having strapped shoulders (e.g., a dress).

The walls 408 and 410 of the extension 400 typically define a channel 412 on each face of the extension 400. This channel 412 is typically configured to be positioned in the gap 316 created by a pair of pegs 314A, 314B of the support base 102, wherein each of the pair of pegs 314A, 314B is, in turn, received by the channel 412 on each side of the extension 400. Each peg 314A, 314B is sized to be able to travel along the channel 412 of the extension 400 during transformation of the collapsible hanger 100 between the expanded and collapsed states.

FIGS. 6 and 7 illustrate a side view of a collapsible hanger 100 in a collapsed state and further depict a peg 314 of the support base 102 positioned within the channel 412 of the first extension 106, in accordance with one embodiment of the present invention. During a transformation of the collapsible hanger 100 from the collapsed state to the expanded state, the frame 104 slides down the length of the neck 302 of the support base 102. A lower surface 502 of the frame 104 is moved along the length of the neck 302 toward an upper surface 312 of the arms 310. The walls 408, 410 of each extension 106, 108 operatively coupled to the frame 104 are forced against the pegs 314A, 314B received within the channels 412 of each extension. The pegs 314 slide within each respective channel 412 to allow for movement of the extensions 106, 108 caused by the repositioning of the frame 104 with respect to the support base 102. Due to the downward force applied by the moving frame 104 and an opposing force applied by the static pegs 314, extensions 106, 108 are forced to rotate about their coupling points to the frame 104 and extend outward, wherein the distal ends 404A and 404B of the first and second extensions 106 and 108, respectively, move away from one another and increase the overall extension width of the collapsible hanger 100.

The fully expanded state of the collapsible hanger 100 is typically achieved at the point of contact between the lower surface 502 of the frame 104 and the upper surface 312 of the arms 310, wherein the upper surface 312 of the arms 310 receives and conforms to the shape of the lower surface 502 of the frame 104. In the expanded state, the extensions 106, 108 are extended to increase separation distance of the distal ends 404A and 404B to be greater than in the collapsed state. In some embodiments, as previously discussed, when moved to the expanded state, the tab 308 engages the button 110 of the frame 104 to releasably lock the collapsible hanger 100 in the expanded state.

In some embodiments, collapsible hanger 100 may be spring-loaded, wherein a transformation of the collapsible hanger 100 to either of the collapsed or expanded states occurs automatically under influence of one or more springs or spring-like members. Additionally, the hanger 100 may be retained in the non-automatically-occurring state, in resistance to the action of the springs, by a releasable locking mechanism as previously described herein.

The collapsible hanger 100 and its components, such as the support base 102, the frame 104, and the first and second extensions 106, 108 may be constructed from plastic, metal, and/or wood. In one embodiment, the collapsible hanger 100 is constructed from a thermoplastic material. In another embodiment, the collapsible hanger 100 and its components are constructed from a combination of different materials.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A collapsible hanger comprising:

a suspendable support base comprising:

a neck having a first end and a second end, the neck comprising a deformable tab; and a support extending from the second end of the neck, the support having a first pair of pegs positioned at a first end of the support and a second pair of pegs positioned at a second end of the support, the first pair of pegs being spaced to form a first gap and the second pair of pegs being spaced to form a second gap;

a frame positionable along a length of the neck, the frame comprising a button, wherein the deformable tab is configured: (i) to engage the button while the collapsible hanger is positioned in an extended state and lock the frame along the neck in the extended state, and (ii) so that actuation of the button applies pressure to the deformable tab causing the deformable tab to disengage the frame and allow the frame to move along the neck;

a first extension operatively coupled to the frame and slidably positioned in the first gap, the first extension defining a first channel positioned along at least a portion of a length of the first extension, the first channel configured to receive and guide the first pair of pegs; and a second extension operatively coupled to the frame and slidably positioned in the second gap, the second extension defining a second channel positioned along at least a portion of a length of the second extension, the second channel configured to receive and guide the second pair of pegs, wherein repositioning the frame along the length of the neck adjusts a separation distance between the first extension and the second extension and causes movement of the first pair of pegs along the at least a portion of the length of the first extension and movement of the second pair of pegs along the at least a portion of the length of the second extension.

2. The collapsible hanger of claim 1, wherein the neck of the suspendable support base further comprises a third channel configured to receive a protrusion of the frame, wherein the protrusion engages the third channel to at least partially retain and guide the frame along the third channel as the frame moves along the length of the neck.

3. The collapsible hanger of claim 1, wherein the suspendable support base further comprises a hooked attachment member extending from the first end of the neck.

4. The collapsible hanger of claim 1, wherein the first and second extensions are rotatably coupled to the frame at proximal ends of each of the first and second extensions.

5. The collapsible hanger of claim 4, wherein repositioning the frame along the length of the neck adjusts a separation distance between distal ends of each of the first and second extensions, the separation distance between the distal ends being greater in the extended state than in a collapsed state.

6. The collapsible hanger of claim 1, wherein each of the first extension and the second extension forms a hook proximate a distal end of each of the first extension and the second extension.

7. The collapsible hanger of claim 1, wherein the collapsible hanger is configured so that in the extended state:

a lower surface of the frame contacts an upper surface of the support; and the upper surface of the support receives and conforms to a shape of the lower surface of the frame.

8. A collapsible hanger comprising:

a suspendable support base comprising:

a neck with a first end and a second end, the neck comprising a deformable tab; and a support arm extending from the second end of the neck, the support arm forming a first gap and a second gap;

a frame positionable along a length of the neck, the frame comprising a button, wherein the deformable tab is configured: (i) to engage the button while the collapsible hanger is positioned in an extended state and lock the frame along the neck in the extended state, and (ii) so that actuation of the button applies pressure to the deformable tab causing the deformable tab to disengage the frame and allow the frame to move along the neck;

a first extension forming a first hinged attachment at a first end of the frame; and a second extension forming a second hinged attachment at a second end of the frame spaced apart from the first hinged attachment, wherein the first extension is slidably coupled to the support arm in the first gap and the second extension is slidably coupled to the support arm in the second gap.

9. The collapsible hanger of claim 8, wherein repositioning the frame along the length of the neck repositions the first extension and the second extension between the extended state and a collapsed state.

10. The collapsible hanger of claim 9, wherein in the extended state, a separation distance between distal ends of the first extension and the second extension is greater than in the collapsed state.

11. The collapsible hanger of claim 8, wherein the support arm has a first peg positioned at a first end of the support arm and a second peg positioned at a second end of the support arm, wherein the first extension defines a first channel positioned along a length of the first extension and the second extension defines a second channel positioned along a length of the second extension, and wherein the first channel and the second channel are configured to receive and guide the first peg and the second peg respectively.

12. The collapsible hanger of claim 11, wherein repositioning the frame along the length of the neck causes movement of the first peg along the length of the first extension and movement of the second peg along the length of the second extension.

13. The collapsible hanger of claim 8, wherein the neck of the suspendable support base further comprises a channel configured to receive a protrusion of the frame, wherein the protrusion engages the channel to at least partially retain and guide the frame along the channel as the frame moves along the length of the neck.

14. The collapsible hanger of claim 8, wherein the suspendable support base further comprises a hooked attachment member extending from the first end of the neck.

15. The collapsible hanger of claim 8, wherein each of the first extension and the second extension forms a hook proximate a distal end of each of the first extension and the second extension.

16. The collapsible hanger of claim 8, wherein the collapsible hanger is configured so that in the extended state:

a lower surface of the frame contacts an upper surface of the support arm; and the upper surface of the support arm receives and conforms to a shape of the lower surface of the frame.

17. A collapsible hanger comprising:

a suspendable support base comprising:

a neck with a first end and a second end, the neck comprising a deformable tab; and a support arm fixedly extending from the second end of the neck;

a frame positionable along a length of the neck, the frame comprising a button, wherein the deformable tab is configured: (i) to engage the button while the collapsible hanger is positioned in an extended state and lock the frame along the neck in the extended state, and (ii) so that actuation of the button applies pressure to the deformable tab causing the deformable tab to disengage the frame and allow the frame to move along the neck;

a first extension rotatably coupled to a first end of the frame; and a second extension rotatably coupled to a second end of the frame, wherein the first extension and the second extension are movably coupled to the support arm.

18. The collapsible hanger of claim 17, wherein repositioning the frame along the length of the neck adjusts a separation distance between the first extension and the second extension.

19. The collapsible hanger of claim 17, wherein the neck further comprises a channel configured to receive a protrusion of the frame, wherein the protrusion engages the channel to at least partially retain and guide the frame along the channel as the frame moves along the length of the neck.

20. The collapsible hanger of claim 17, wherein the collapsible hanger is configured so that in the extended state:

a lower surface of the frame contacts an upper surface of the support arm; and the upper surface of the support arm receives and conforms to a shape of the lower surface of the frame.

* * * * *